US006101782A

United States Patent [19]

Abney et al.

[11] Patent Number: 6,101,782

[45] Date of Patent: Aug. 15, 2000

[54] ELECTRICAL CONTROLLER FOR ROOFING APPARATUS

[75] Inventors: Ernest Craig Abney, Deltona, Fla.; Don Albert Neifer; Mark Richard Waugh, both of Granville, Ohio

[73] Assignee: Owens Corning Fiberglass Technology, Inc., Summit, Ill.

[21] Appl. No.: 09/174,157

[22] Filed: Oct. 16, 1998

Related U.S. Application Data

[63] Continuation-in-part of application No. 09/052,735, Mar. 31, 1998.

[51] Int. Cl.[7] ..... E04D 15/04

[52] U.S. Cl. ..... 52/749.12; 52/404.1; 52/407.4; 52/746.11; 242/557; 242/598.5; 242/610.3

[58] Field of Search ..... 52/749.12, 746.11, 52/404.1, 478, 742.12, 407.2, 407.4, 404.5, 408, 409; 242/557, 598.5, 610.3, 555.3, 543; 182/4 J

[56] References Cited

U.S. PATENT DOCUMENTS

| | | | |
|---|---|---|---|
| 3,983,676 | 10/1976 | Gilpin . | |
| 4,068,446 | 1/1978 | Brueske . | |
| 4,864,837 | 9/1989 | Fielden, Jr. | 52/749.12 X |
| 4,967,535 | 11/1990 | Alderman . | |
| 4,993,207 | 2/1991 | Burke | 52/749.12 |
| 5,205,103 | 4/1993 | Burton | 52/749.12 |
| 5,381,597 | 1/1995 | Petrove | 52/749.12 X |
| 5,551,203 | 9/1996 | Alderman et al. | 52/749.12 X |
| 5,653,081 | 8/1997 | Wenrick et al. | 52/749.12 X |
| 5,653,083 | 8/1997 | Alderman et al. | 52/749.12 |
| 5,664,740 | 9/1997 | Alderman et al. | 52/749.12 X |
| 5,685,123 | 11/1997 | Alderman et al. | 52/749.12 |

*Primary Examiner*—Carl D. Friedman
*Assistant Examiner*—Yvonne M. Horton
*Attorney, Agent, or Firm*—Inger H. Eckert; Stephen W. Barns

[57] ABSTRACT

A controller for propelling a carriage along a plurality of purlins, and method of using same are disclosed. A plurality of carriage sections are joined to form a continuous carnage spanning a plurality of purlins. A plurality of puller assemblies are attached to selective ones of the carriage sections. A controller is connected to the plurality of puller assemblies. The controller can be actuated to a master control mode which simultaneously engages the plurality of puller assemblies, thereby propelling the carriage along the purlins. The controller can also be selectively actuated to a selective mode which engages one of the puller assemblies.

12 Claims, 3 Drawing Sheets

ELECTRICAL CONTROLLER FOR ROOFING APPARATUS

CROSS REFERENCE TO RELATED APPLICATIONS

This application is a Continuation-In-Part of pending U.S. patent application Ser. No. 09/052,735, filed on Mar. 31, 1998.

TECHNICAL FIELD AND INDUSTRIAL

1. Applicability of the Invention

This invention relates to the construction of an insulated metal roof structure for use in commercial and industrial buildings.

2. Background of the Invention

Metal roof structures typically comprise a series of parallel rafter beams extending across the building in one direction, and purlin beams parallel to each other mounted on top of the rafters extending in a direction normal to the rafters. Insulation material in long blankets is placed in the area between purlins. The blankets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer on insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material is supported between the purlins beneath the hard roofing material. Various methods of supporting the insulation material have been used. Mounting straps or wire mesh which are attached to or draped over the purlins forming a lattice have been used. This is referred to as banding. A support sheet, typically made of vinyl and acting as a vapor barrier, is then rolled onto the lattice, and insulation material is placed between adjacent purlins and over the support sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the support sheet can support the insulation material and the lattice no longer serves any useful purpose.

Some systems dispense with the lattice and use the support sheet itself to support the insulation material. The support sheet is dispensed from a roll and draped from adjacent purlins. Insulation material is then placed on top of the support sheet. A carriage, such as that disclosed in U.S. Pat. No. 4,967,535 to Alderman, has been used to aid in the dispensing of the support sheet. The carriage is positioned on top of the purlins and travels along the length of the purlins during the roof construction. A roll of the support sheet material is mounted on the carriage and the support sheet is dispensed from the roll and placed on top of the purlins. As the carriage travels the length of the purlins, the support sheet is draped across the purlins.

The carriage can be any length up to the width of the roof itself. For example, the carriage can be comprised of a plurality of carriage sections which are joined together so that they span the entire width of the roof. Each carriage section has a roll or a plurality of rolls of support sheet which are dispensed as the carriage travels along the purlins. Preferably, the support sheets are provided with a width appropriately sized so that the support sheet extends between two adjacent purlins. The carriage is then propelled along the length of the purlins so that the carriage sections move in unison.

In the past, the carriage was manually pushed across the roof along the length of the purlins by means of push rods. The workers standing on a completed section of the roof structure would manually push the carriage sections to the desired position. Another method of advancing the carriage was by pulling the carriage across the roof by means of a relatively long cable and large winch fastened to the carriage. For a large number of carriage sections, multiple cables and winches were used. The cable was typically 200 feet long and had a conventional hook attached at the end of the cable. The cable was reeled out from the spool of the winch and then hooked to a flange of a rafter beam. If the roof structure was longer than 200 feet, the cable was attached to the farthest rafter beam which the cable was able to reach. The winch was then manually operated to take up the cable about the spool of the winch so as to advance the carriage. It was preferred that the cable be as long as possible, so that the cable did not have to be re-attached to a different rafter beam often. Because the winch is attached to the carriage and moves over and across the rafter beams, the cable is laid across the tops of all the rafter beams between the carriage and the end of the roof structure. However, it can be difficult and time consuming to unroll the cable and pull the end of the cable across the rafter beams 200 feet away from the carriage. It is also difficult to initially attach the hook at the end of the roof structure since this requires a worker to climb to the top of the end of the roof structure. Since the cable is relatively long, the cable is relatively heavy and awkward to handle. Also, the size of the winch is relatively large and heavy to accommodate the length of the cable required to span across the roof structure. Further, the cable stringing and attaching process must be accomplished in a safe manner to protect the workers, and in an open rafter and purlin structure. This can require extensive safety measures.

It would be desirable to have an apparatus and method for moving the carriage along the length of the purlins which is relatively simple, fast, and safe to perform.

SUMMARY OF THE INVENTION

The above objects as well as other objects not specifically enumerated are achieved by a method for propelling a plurality of carriage sections along a roof structure. The apparatus and method provides for a relatively simple and fast system for moving the carriage.

The apparatus of the present invention provides is suitable for use on a roof structure of the type having a plurality of purlins spaced apart from one another in a parallel arrangement. The apparatus includes a plurality of carriage sections which are movable along the length of the purlins. The carriage sections are joined together to form a carriage spanning the purlins. A plurality of puller assemblies are attached to selective ones of the plurality of carriage sections. The puller assemblies are engageable to move the carriage along the purlins. A controller is electrically connected to a source of power and the puller assemblies. The controller is operable to a master control mode, wherein the plurality of puller assemblies are simultaneously engaged to move the carriage sections in unison. The controller is also operable to a selective mode, wherein one of the puller assemblies is selectively engaged to move the carriage section to which that puller assembly is attached.

The method of the present invention includes first joining the plurality of carriage sections to form a continuous carriage spanning a plurality of purlins. The plurality of puller assemblies are then attached to selective ones of the carriage sections. The controller is also connected to the plurality of puller assemblies. The controller can be actuated to a master control mode which simultaneously engages the plurality of puller assemblies, thereby propelling the carriage along the purlins. The controller can also be selectively actuated to a selective mode which engages one of the puller assemblies.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 2:
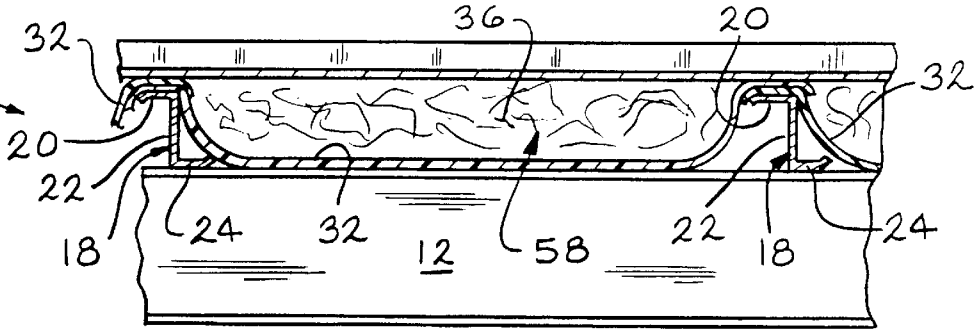
FIG. 2 is a schematic sectional view taken along Lines 2—2 of FIG. 1 illustrating a completed section of the insulated roof structure.
Figure 1:
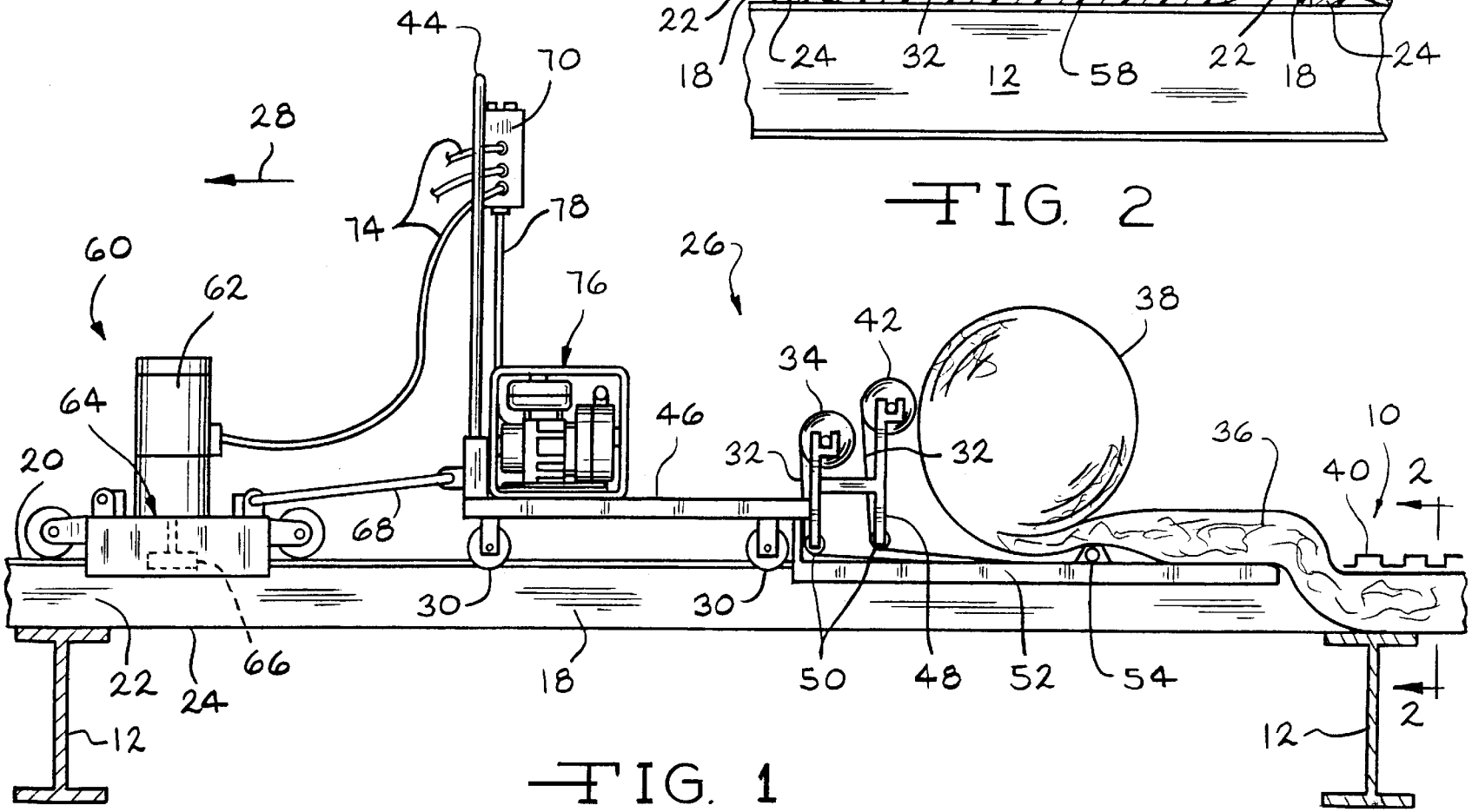
FIG. 1 is a schematic elevational side view of a carriage including a puller assembly and an electrical controller, in accordance with the present invention.

Referring to FIGS. 1 and 2, there is illustrated a partially completed building roof structure, indicated generally at 10. The roof structure is supported by a building framework which includes main rafter beams 12 positioned parallel to each other. A plurality of purlins 18, spaced apart and arranged parallel to each other, is fastened on top of the rafters in a direction normal to the rafters. The building framework may have two sloped sections (not shown) which are joined together to form a peak. The spacing of the rafter beams is typically within the range of from about 25 to about 30 feet (7.6 to about 9.1 meters) on centers. The spacing of the purlins is typically about 5 feet (1.52 m) on centers. As best shown in FIG. 2, the purlins typically have a generally Z-shaped cross-section, and include a horizontally extending upper portion 20, a vertically extending web 22, and a horizontally extending lower portion 24. Of course, the roof structures may be constructed from bar joists or trusses, and the invention as described herein will work equally well with purlins, bar joists or trusses. The use of the term "purlins" in this specification and claims includes not only traditional purlins, but also joists, trusses, and other suitable structural members for supporting the roof structure.

Broadly stated, the roof structure is constructed by use of a carriage, indicated generally at 26, which rides on the upper portion 20 of the purlins and travels along the length of the purlins in a downstream direction, represented by an arrow 28, as shown in FIG. 1. Preferably, the carriage has rollers 30, rotatably mounted on the carriage, which roll along the upper portions of the purlins. As the carriage is moved, a support sheet 32 is payed out from rolls 34 and 42, as will be discussed below. The support sheet is draped on top of adjacent purlins so that the longitudinal edges of the support sheet depend from the upper portion of the purlins, as shown in FIG. 2. The support sheet supports a layer of insulation material 36 which is placed on top of the support sheet between the adjacent purlins. The insulation material is typically dispensed from a roll 38 but can be applied by any suitable manner, such as by applying elongated insulation batts on top of the support sheet. Alternatively, a layer of insulation may be placed laterally across the purlins. After the insulation material has been placed on the support sheet, long sheets of hard roofing material 40, such as metal roof decking, are then attached to the upper portion of the purlins over the support sheet and insulation. The hard roofing material can be fastened to the purlins in any suitable manner, such as by threaded fasteners or clips. The attachment of the hard roofing material presses down on the edges of the support sheet which are sandwiched between the upper portion 20 of the purlins and the hard roofing material 40, so that the support sheet supports the insulation between the purlins.

Because the hard roofing material comes in long sheets, typically 30 to 35 feet (9.1 to 10.7 m), and the roofs generally have two sloped roof sides, it is customary to construct a first section of the roof structure along the width of the sloped roof side and then proceed along the length of the structure from one end to the other. The workers stand on the previously attached first section of the roof structure to assemble the next section of roof. The carriage travels along the length of the purlins and is moved by the workers as each new section of roof is assembled.

Figure 3:
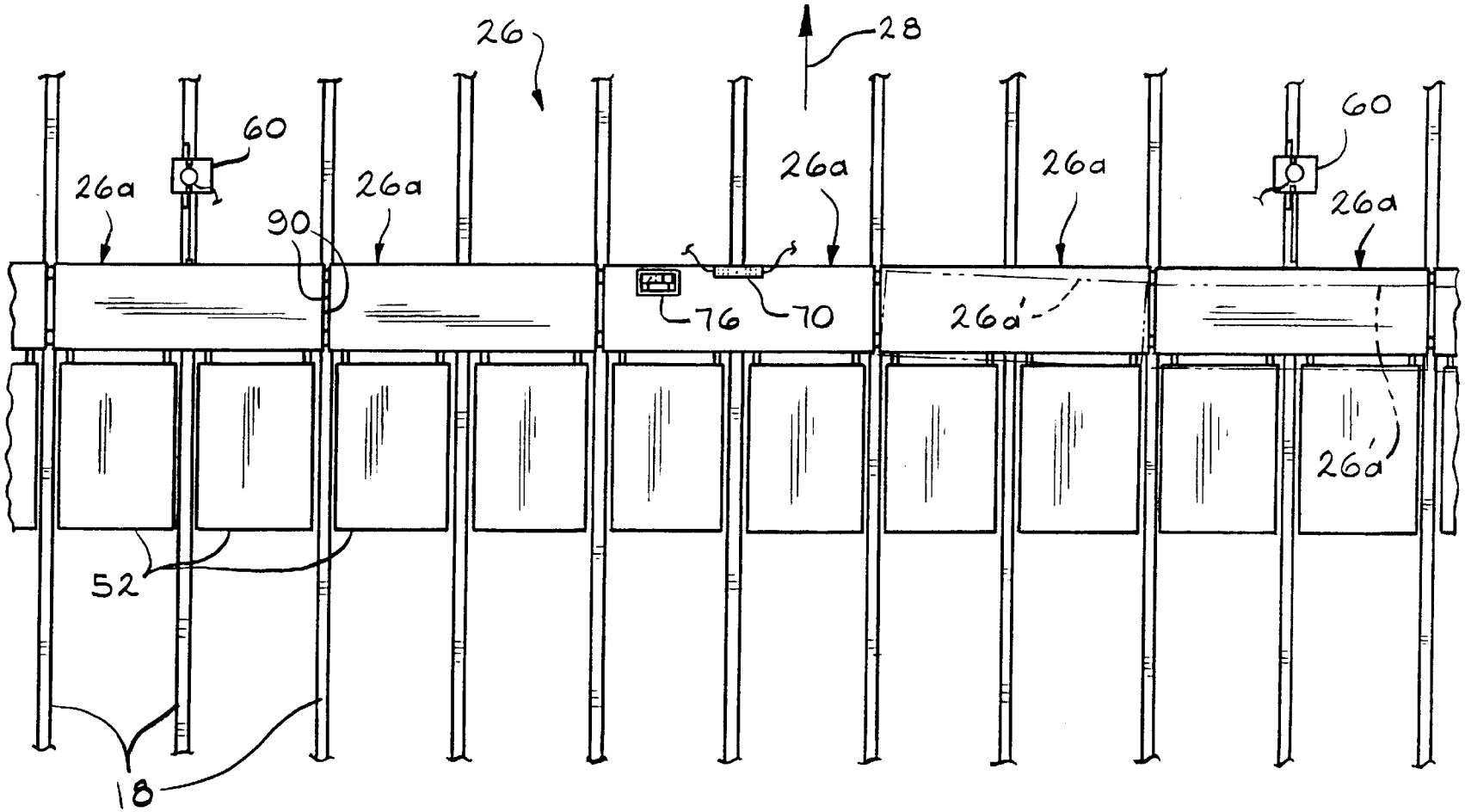
FIG. 3 is a schematic top plan view of a plurality of carriage sections on top of the roof structure.

As best shown in FIG. 3, the carriage is comprised of a plurality of carriage sections 26*a* which are joined together. The carriage sections are joined at their respective ends 90 so that they are generally in alignment with each other, as shown in FIG. 3. The carriage sections can be joined together by any suitable manner, such as by being clamped or bolted together. Preferably, the carriage spans the entire width of the sloped section of the roof, but it can be any length up to the width of the roof itself. Note that in FIG. 3, the support sheets and insulation material are removed for clarity.

To construct the roof structure 10, the carriage 26 is propelled across the purlins in the downstream direction 28. As the carriage moves along the length of the purlins, the ends of the support sheets 32 are draped across the upper portion of adjacent purlins. Preferably, the total width of the support sheet is wider than the distance between the purlins. Adjacent support sheet rolls may be positioned in a staggered and offset manner such that they are not co-linear with each other. Preferably, a carriage section 26*a* covers two purlin spans, as shown in FIG. 3. Each carriage section preferably has both a leading roll 34 and a trailing roll 42 of insulation support sheet, one roll for each of two adjacent purlin spans, as shown in FIG. 1. The edge of the support sheet from the trailing roll 42 will be draped on top of the edge of the support sheet from the leading roll 34 as the carriage moves in the downstream direction. Multiple identical carriage sections having a leading and trailing roll can, therefore, be joined together, with every roll being staggered from an adjacent roll.

The carriage 26 can be any suitable apparatus which moves along the top of the purlins and dispenses the support sheet. As seen from FIG. 1, the carriage preferably includes safety handrails 44 and a deck 46 for the workers to stand on while operating or moving the carriage. The rollers 30 are mounted from the deck 46 of the carriage. Preferably, the carriage is equipped with two rollers (front and rear) for each purlin, as shown in FIG. 1. The carriage also includes a framework 48 for mounting the rolls 34 and 42. Mounted on the framework are turning bars 50 which extend laterally across associated support sheets and are positioned slightly above the upper portions 20 of the purlins 18 so as to direct the support sheet to a generally horizontal position.

Attached to the carriage is an optional plate 52 which extends from the carriage in an upstream direction opposite the downstream direction 28. The plate supports the payed out portion of the support sheet and insulation material so that the support sheet does not drape downwardly, thereby pulling the longitudinal edges of the support sheet off the upper portion of the purlins. If sufficiently built, the plate can be used for fall protection for the workers to prevent them from falling off the leading edge of the previously completed section of roof. The plate can be attached to the carriage by any suitable means. The plate follows the carriage as the carriage moves along the length of the purlins. Preferably, the plate has wheels 54 which also support the plate by rolling along the upper portion 20 of the purlins 18. However, it is not required that the payed out support sheet be supported by the plate. The carriage could be modified so that the support sheet is payed out in such a manner that the support sheet is underneath the plate. If desired, the roll 38 of insulation material 36 could be positioned on the plate 52 above the support sheet.

The space between the vertical webs 22 of adjacent purlins 18 generally defines an insulation cavity 58, as shown in FIG. 2. The insulation cavity has a generally rectangular cross-sectional shape. The support sheet supports the insulation material in the insulation cavity. The support sheet can also be used as a vapor barrier and/or for aesthetic purposes. The support sheet can be of any suitable material for the stated purposes, such as vinyl or foil faced paper.

The carriage 26 is propelled or advanced along the length of the purlins in the downstream direction 28 by a plurality of puller assemblies 60. The puller assembly 60 can be any suitable apparatus which is attached to or mounted on a carriage section. For example, the puller assembly can include a motor 62 for driving a drive mechanism 64 which rotates a wheel 66 frictionally engaging the purlin, as described in co-pending U.S. patent application Ser. No. 09/052,735 which is incorporated by reference herein. The rotation of the wheel causes the puller assembly and the carriage to move along the length of the purlins. The puller assembly 60 can be attached to the carriage section by any suitable manner, such as by a cable 68, or can be mounted directly on the carriage section.

When a relatively large number of carriage sections are used, multiple numbers of puller assemblies are used to move the carriage. If desired, a puller assembly 60 can be attached to each carriage section. However, it is preferred to use a fewer number of puller assemblies than the total number of joined carriage sections. For example, a puller assembly can be attached to every fourth carriage section, as shown in FIG. 3. Of course, any suitable number of puller assemblies can be used to move multiple joined carriage sections.

Figure 4:
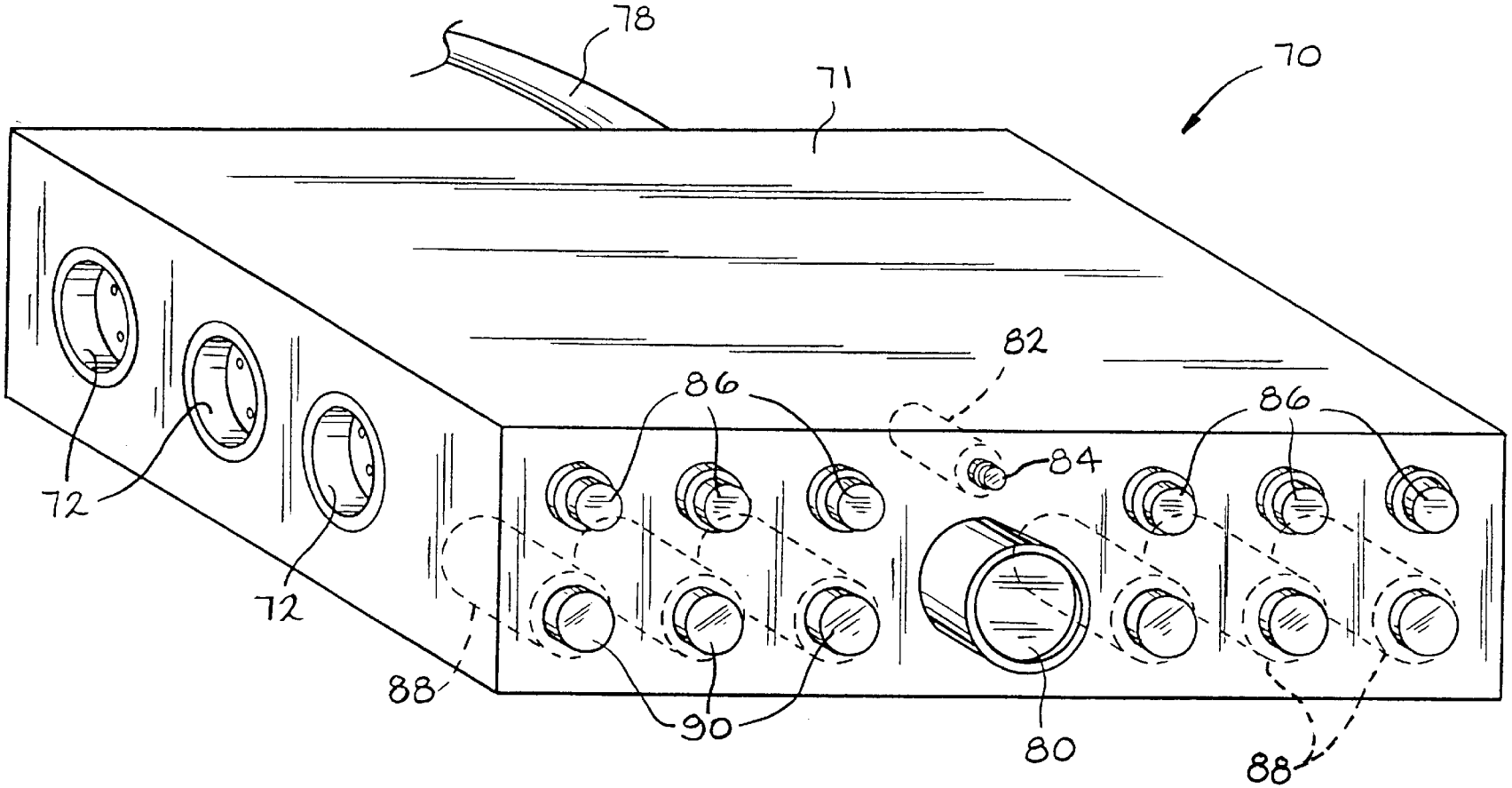
FIG. 4 is a schematic perspective view of the electrical controller.

When a plurality of puller assemblies is used, it is desirable to simultaneously control the plurality of puller assemblies so that the carriage sections will move in unison along the length of the purlins. The puller assemblies can be controlled by a single electrical controller 70, an embodiment of which is illustrated in FIG. 4. The controller is preferably mounted on one of the carriage sections, such as for example, on the handrail 44. The controller includes a housing 71 having a plurality of receptacles 72. The receptacles provide for electrical connection with each puller assembly via a cord 74, as shown in FIG. 1. In the embodiment of the controller 70 illustrated in FIG. 4, the controller 70 includes three receptacles on each side thereof, to accommodate six puller assemblies (there are three shown, and three hidden in FIG. 4). Of course, the controller can include any suitable number of receptacles. The controller is connected to a source of power 76, such as a generator or battery, via a power conduit 78. Preferably, the controller controls the puller assemblies by directing electrical power from a single source to the plurality of puller assemblies. Of course, multiple power sources can be used. Each puller assembly can also be provided with its own source of power, wherein the controller controls every source of power.

The controller includes a single master control switch 80. The master control switch 80 is operable to a master control mode which simultaneously engages the puller assemblies so that the carriage sections 26*a* are propelled along the purlins in unison. Preferably, the master control switch 80 is a two-position switch for permitting or preventing electrical communication between the source of power 76 and the motors 62 of the puller assemblies. The controller preferably includes a control overload relay 82 to help protect the electrical circuitry within the controller. The control overload relay can be any suitable circuitry which disrupts electrical communication between the source of power 76 and the electrical circuitry within the controller when an undesirable electrical current or voltage is detected which may cause harm to the electrical components. For example, the control overload relay 82 can be a thermal protection relay triggered by an electrical power drain. The control overload relay 82 can be reset automatically, such as by a time delay circuit, or manually reset, such as by a reset switch 84.

In addition to controlling the plurality of puller assemblies simultaneously with the master control switch, the controller 70 can also be actuated to control or engage individual puller assemblies. For example, it may be desirable to control a single puller assembly if the carriage section to which it is attached is misaligned with the other carriage section, as will be described in further detail below. As shown in FIG. 4, the controller 70 includes a plurality of operator switches 86 and a plurality of associated overload relays 88. The overload relays 88 can be any suitable circuitry to help protect the controller 70, the motors 62, and the source of power 76. Preferably, the overload relays 88 are configured so that they can be reset automatically, such as by a time delay circuit, or manually reset, such as by associated reset switches 90. In the embodiment shown in FIG. 4, the controller includes six operator switches, relays, and reset switches corresponding to the six receptacles 72. Preferably, the operator switches are two position switches for preventing or permitting electrical communication between the source of power and the plurality of puller assemblies. The master control switch 80 and the operator switches may include an indicator light (not shown) to indicate the position of the switch.

The method of propelling the carriage 26 along the purlins in the downstream direction 28 will now be described. If the carriage sections 26*a* are in alignment in a direction normal to the length of the purlins, as illustrated in FIG. 3 with solid lines, an operator actuates the master control switch 80 so that the plurality of puller assemblies move the carriage section 26*a* in unison. Preferably, the carriage is moved a relatively short distance so that one or two panels of hard roofing material 40 can be fastened to the purlins. This process is repeated to complete the roof structure.

Under certain circumstances, the carriage sections can become misaligned. For example, a carriage section can be prevented from moving because of an obstruction, such as fasteners extending upward from the upper portions of the purlins. When a carriage section confronts the obstruction, the remaining carriage sections may continue to be propelled in the downstream direction before being prevented from further movement, thereby causing a misalignment of the carriage. There is illustrated in FIG. 3, an example of the carriage 26 being misaligned such that a pair of carriage sections 26*a*', shown in phantom lines, are shifted with respect to the remaining carriage sections 26*a*. When the carriage becomes misaligned, the controller 70 is actuated to a stop mode to prevent the puller assemblies from moving the carriage. The controller is then actuated to a selective mode, wherein one or more of the puller assemblies are engaged to align the carriage. For example, the puller assembly 60 associated with the misaligned carriage section 26*a*', as illustrated in FIG. 3, can be actuated to move the carriage sections 26*a*' from their misaligned positions, as indicated by the phantom lines 26*a*', to an aligned position, as indicated by the solid lines 26*a*. The misaligned carriage section 26*a*' can be moved by actuating the associated operator switch 86 to provide power to the associated puller assembly. After the carriage 26 has been realigned, the operator can then actuate the master control switch 80 to move the carriage sections in unison.

Although the carriage has been described as being propelled in the downstream direction 28, the puller assemblies can be configured to propel the carriage in a direction opposite the downstream direction, such as by back driving the motors 62 of the puller assemblies 60. If desired, the controller 70 can have additional controls to actuate the puller assemblies in both directions.

The principle and mode of operation of this invention have been described in its preferred embodiments. However, it should be noted that this invention may be practiced otherwise than as specifically illustrated and described without departing from its scope.

What is claimed is:

1. An apparatus for providing a roof structure having a plurality of purlins spaced apart from one another in a parallel arrangement, the apparatus comprising:

a plurality of carriage sections movable along the length of the purlins, said carriage sections being joined together to form a carriage;

a plurality of puller assemblies attached to selective ones of the plurality of carriage sections, said puller assemblies engageable to move said carriage along the purlins; and a controller electrically connected to a source of power and said puller assemblies, said controller operable to a master control mode, wherein said plurality of puller assemblies are simultaneously engaged to move said carriage sections in unison, and said controller is operable to a selective mode, wherein at least one but not all of said puller assemblies is selectively engaged to modify the alignment of the plurality of carriage sections.

2. The apparatus of claim 1, wherein said controller includes a single master control switch operable between a first position, wherein electrical communication is prevented between said source of power and said plurality of puller assemblies, and a second position, wherein electrical communication is permitted between said source of power and said plurality of puller assemblies causing said carriage sections to move in unison.

3. The apparatus of claim 2, wherein said controller includes a master overload relay to disrupt electrical communication between said source of power and said plurality of puller assemblies.

4. The apparatus of claim 1, wherein said controller includes a plurality of operator switches each electrically connected to a respective one of said plurality of puller assemblies such that each operator switch prevents or permits electrical communication between said source of power and said respective puller assembly.

5. The apparatus of claim 4, wherein said controller includes a plurality of overload relays associated with each ones of said plurality of operator switches, said operator relays operable to disrupt electrical communication between said source of power and said plurality of operator switches.

6. The apparatus of claim 1, wherein said each puller assembly has an electrical motor driving a wheel engaged with said purlin to propel said puller assembly along the purlins.

7. The apparatus of claim 1, wherein said source of power is a generator.

8. The apparatus of claim 1, wherein said source of power is a battery.

9. A method of propelling a carriage along a plurality of purlins, the method comprising the steps of:

a. providing a plurality of carriage sections;

b. joining adjacent carriage sections to each other to form a continuous carriage spanning a plurality of purlins;

c. providing a plurality of puller assemblies attached to selective ones of the plurality of carriage sections, the puller assemblies being engageable to move the carriage along the purlins;

d. providing a controller connected to the plurality of puller assemblies;

e. actuating the controller to a master control mode which simultaneously engages the plurality of puller assemblies to propel the carriage along the purlins; and f. selectively actuating the controller in a selective mode which engages at least one but not all of the puller assemblies to modify the alignment of the plurality of carriage sections.

10. The method of claim 9 including a step (g) of actuating the controller to a stop mode to prevent the puller assemblies from moving the carriage prior to step (f).

11. The method of claim 10, wherein the controller is actuated to a stop mode when an obstruction is encountered by the carriage causing the carriage to become misaligned such that the carriage sections are not in alignment with each other, the method further including the step of removing the obstruction and then subsequently selectively actuating the controller in a selective mode to engage at least one of the puller assemblies to re-align the carriage.

12. A method of propelling a carriage along a plurality of purlins, the method comprising the steps of:

a. providing a plurality of carriage sections;

b. joining adjacent carriage sections to each other to form a continuous carriage spanning a plurality of purlins, wherein the carriage sections are in alignment with each other;

c. providing a plurality of puller assemblies attached to selective ones of the plurality of carriage sections, the puller assemblies being engageable to move the carriage along the purlins;

d. providing a controller connected to the plurality of puller assemblies;

e. actuating the controller to a master control mode which simultaneously engages the plurality of puller assemblies to propel the carriage along the purlins;

f. actuating the controller to a stop mode to prevent the puller assemblies from moving the carriage when a first carriage section is misaligned with the carriage; and g. actuating the controller to a selective mode which engages one of the puller assemblies to move the first carriage section to an aligned position with respect to the other carriage sections.

* * * * *